United States Patent [19]

Buckstead et al.

[11] 4,349,308

[45] Sep. 14, 1982

[54] FRONT END LOADER WITH BUCKET EJECTOR ASSEMBLY

[75] Inventors: John W. Buckstead, Overland Park; Frederick J. Hoppe, Shawnee Mission, both of Kans.; Dennis W. Williams, Kansas City, Mo.

[73] Assignee: Paccar, Inc., Bellevue, Wash.

[21] Appl. No.: 153,711

[22] Filed: May 27, 1980

[51] Int. Cl.[3] ..... E02F 3/81

[52] U.S. Cl. ..... 414/725; 37/DIG. 2; 414/704

[58] Field of Search ..... 414/725, 722, 704; 37/DIG. 2

[56] References Cited

U.S. PATENT DOCUMENTS

| | | | |
|---|---|---|---|
| 3,176,863 | 4/1965 | Kuhl | 414/725 |
| 3,363,742 | 1/1968 | Hoppe . | |
| 3,523,621 | 8/1970 | Anderson et al. | 414/725 X |
| 3,543,960 | 12/1970 | Wagner | 414/725 X |
| 3,642,160 | 2/1972 | Rockwell et al. | 414/725 X |
| 4,144,980 | 3/1979 | Meyer | 414/725 |

OTHER PUBLICATIONS

Dart D600 Brochure, 10/77.
Dart 600C Brochure, 4/79.
Wagner "Eject-O-Dump" Brochure.
Rockland Ejector Buckets Bulletin No. 1067EJ.

*Primary Examiner*—Robert J. Spar
*Assistant Examiner*—Terrance L. Siemens
*Attorney, Agent, or Firm*—Schmidt, Johnson, Hovey & Williams

[57] ABSTRACT

A tractor mounted front end loader with a swingable boom assembly carrying a bucket, there being an ejector assembly for the bucket. The boom arms are shortened to place the center of gravity of the bucket proximal to the front tires of the loader, to place the cutting edge of the bucket closer to the center line of the front axle of the tractor; to place the boom to bucket pivot proximal to the surface upon which the loader is working and the cutting edge of the bucket in a horizontal plane slightly below that of the boom to bucket pivot, as compared with a loader without a bucket ejector assembly, to the end that bucket capacity is increased, reach and dump height are increased, cycle time is reduced and greater breakout force can be developed inasmuch as the bucket can be dumped, by use of the ejector assembly, while in a horizontal position. The ejector assembly includes upper and lower swingable panels within the bucket, hinged together with means for sealing the hinge. Rollers are provided at the normally forwardmost edge of the lower panel, for engagement with the bucket, and a scraper is provided in front of the forwardmost edge of the lower panel for cleaning a pathway in front of the roller during operation of the ejector assembly by a pair of cylinder driven arms.

6 Claims, 6 Drawing Figures

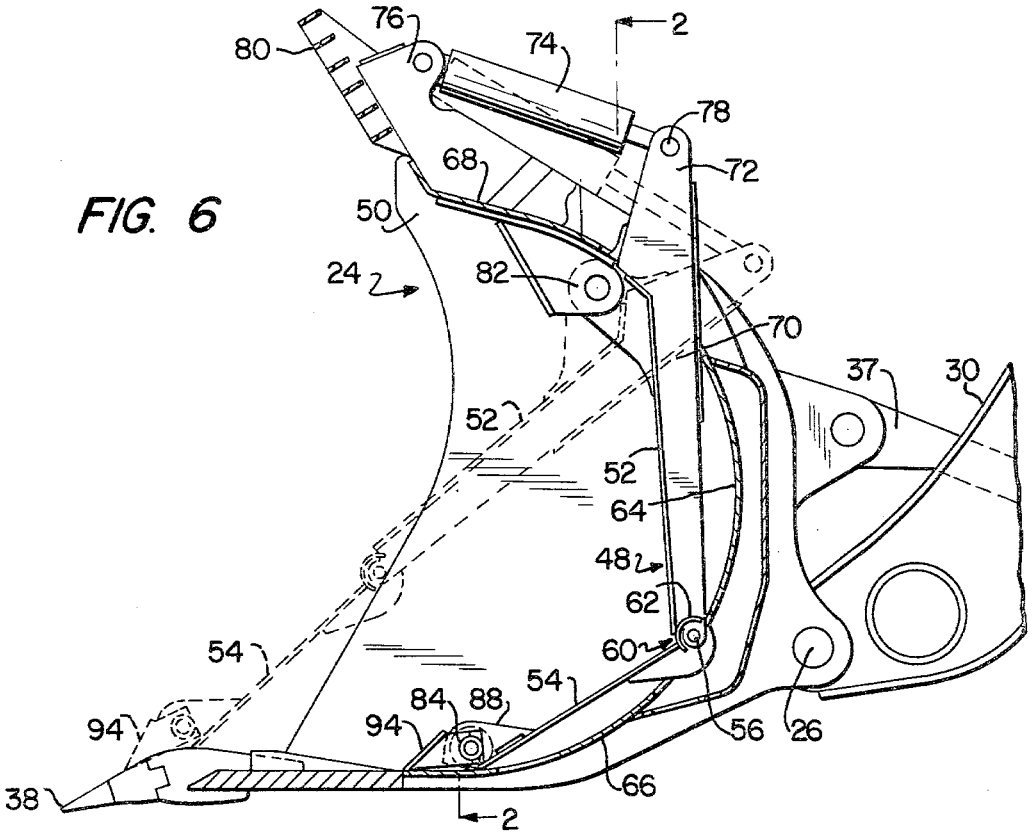
FIG. 6
FIG. 5
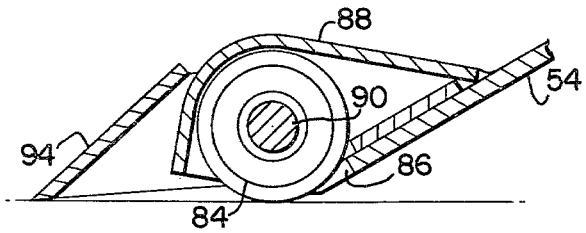
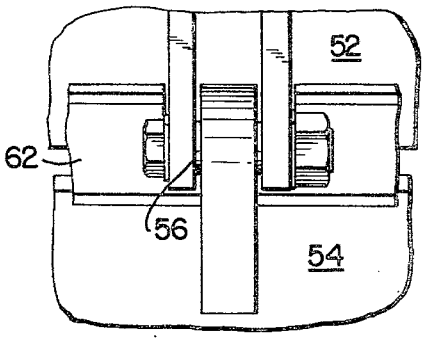
FIG. 3
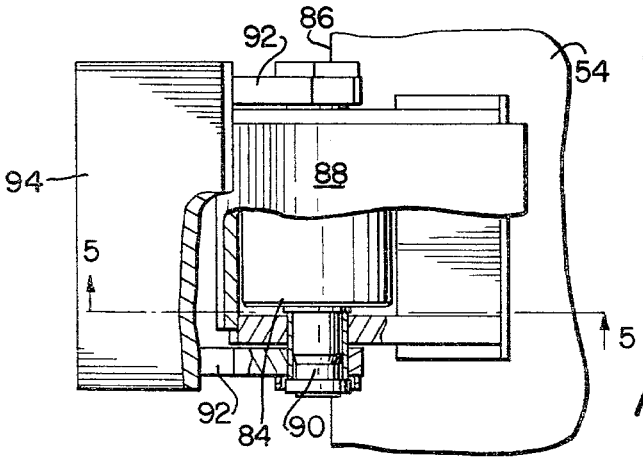
FIG. 4

FRONT END LOADER WITH BUCKET EJECTOR ASSEMBLY

TECHNICAL FIELD

The front end loader disclosed herein is used for the handling of large loads of bulk materials, such as rock, ore, coal and the like and particularly in moving such materials from a blasted pile on the working surface into a truck.

BACKGROUND ART

Front end loaders have been widely used in the handling of bulk materials and have been of increased capacity in recent years for greater efficiency and economy of operation. Various efforts have been made to increase the power and capacity of such loaders, as exemplified for instance by U.S. Pat. No. 3,363,792, issued Jan. 16, 1962. Said patent, owned by the assignee of this application, illustrates a front end loader designed for a bucket capacity on the order of 15 cubic yards, and which has enjoyed commercial success. However, efforts have continued to design an acceptable front end loader with a bucket capacity on the order of 18–24 cubic yards. While many parties have attempted such a design none, as yet, have met with commercial success for such reasons as initial cost, the requirement for special tires, lack of potential as a utility machine and lack of physical dimensions, such as dump height and reach, and bucket linkage to effectively load a 170 ton truck.

One of the problems that designers of 18–24 cubic yard loaders have not overcome is the enormous amount of hoisting energy that is lost when the bucket of a loader with a traditional bellcrank mechanism is dumped. In order to dump, the bucket must rotate forward from the rollback position to the full-dump position through an angle of nearly 130°. This alone lowers the center of gravity of the load a substantial distance. The load then falls further out of the bucket and into the truck. As an example, in order to accommodate dumping, the load center of gravity must initially be raised 21 feet to somewhere above the truck. The load center of gravity then falls 11 feet into the truck, for a net elevation change of 10 feet. Approximately 50% of the hoisting energy used is lost. Clearly, reducing this energy loss would increase the productive capacity of a front end loader.

A mechanism that can substantially reduce the energy loss is an ejector assembly, placed in the bucket of the loader and used to move the contents of the bucket therefrom while the bucket remains in a raised, but horizontal position. Various ejector assemblies have been developed, but these have been inefficient due to operating characteristics and undue wear to material intrusion into the parts of the ejector assembly. Also there are advantages, in terms of reach and dump height, increased bucket capacity, cycle time, bucket breakout force and the like to be derived from the use of an ejector assembly in the bucket and the consequent horizontal dumping position. For instance, a bucket with an ejector assembly can place the last load in a truck with only a 25% loss in hoisting energy. Other advantages of the use of an ejector assembly, as compared to the traditional bucket geometry, include an increase in pile height up to 40% and reach up to 20%.

SUMMARY OF THE PRESENT INVENTION

By placing an ejector assembly in the bucket of the loader, to eject the material from the bucket, it is not necessary to tip the bucket down 45° to dump the contents thereof into a truck, but rather the bucket may be raised and then partially tilted to a horizontal position, over the truck, and the ejector assembly used to move the contents from the bucket and into the truck. As a result of not having to raise the bucket high enough above the truck to permit tipping of the bucket through a total of 130° angle to dump, it has been found that the geometry of the front end loader may be altered to gain greater operating efficiency. Specifically, the boom arms may be shortened to thereby place the center of gravity of the bucket closer to the front tires of the tractor, which provides for increased tip load rating of the loader and, therefore, permits increasing the capacity of the bucket. Also, due to shorter boom arms and complete tipping of the bucket not being required, cycle time and lifting forces are reduced. By moving the boom to bucket pivot proximal to the front tires and lowering said pivot proximal to the surface upon which the loader is working, greater breakout force is achieved and bucket capacity can be increased.

The ejector assembly itself is in the form of an upper panel and a lower panel, interconnected by a sealed hinge, and activated by a pair of hydraulic cylinders having equal displacement so that the panels may equally move from a position adjacent the rear of the bucket to a position substantially spanning the bucket and thereby ejecting the material from the bucket.

Rollers are provided on the forwardmost edge of the lower panel and a swingable scraper precedes the rollers to sweep the bottom of the bucket as the ejector assembly is operated with the bucket in a horizontal position.

BRIEF DESCRIPTION OF THE DRAWINGS

FIG. 3 is an enlarged rear elevational view of the hinge means connecting the upper and lower panel of the ejector assembly;

FIG. 4 is a top plan view, fragmentary, with parts broken away, showing the roller assembly carried at the forwardmost edge of the lower panel of the ejector assembly;

FIG. 5 is a sectional view of the roller assembly taken on lines 5—5 of FIG. 4; and FIG. 6 is an end view of one end of the bucket, with parts being broken away to reveal details of construction, the panels of the ejector assembly being shown in elevation.

DETAILED DESCRIPTION

Figure 1:
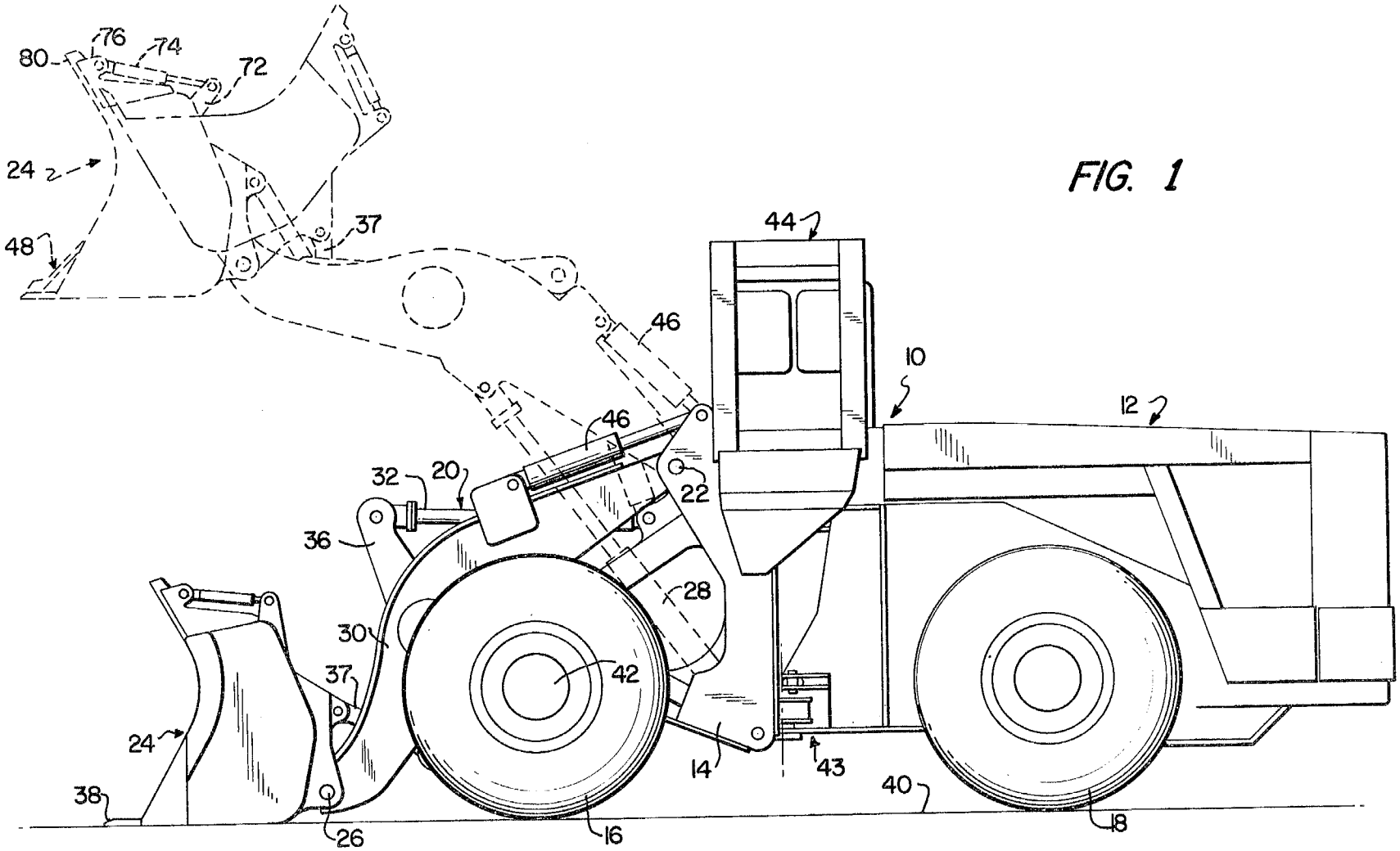
FIG. 1 is a side elevational view of the front end loader with ejector bucket assembly, the bucket being shown in a lowered position in full lines; in a raised position in dot-dash lines; and in a dumping position in dashed lines.

The front end loader disclosed herein is of the type generally shown in U.S. Pat. No. 3,363,792, is broadly designated by the numeral 10 and includes, as its basic components, a tractor or power unit 12 presenting a frame 14 at the normally forwardmost end thereof, the tractor and frame being supported by a pair of front tires 16 and a pair of rear tires 18;

A boom assembly, broadly designated as 20 has one end thereof swingably connected to the tractor 12 through frame 14 as at a pivot point 22. The boom assembly 20 has a bucket 24 pivotally mounted on the end thereof opposite to that connected to the frame 14 as by a bucket to boom pivot 26.

A pair of rams 28 are provided for imparting swinging movement to the boom arms 30, there normally being a pair of said arms 30 and a corresponding pair of driving rams 28.

A pair of piston and cylinder tilting units 32 are provided, each having the head end thereof pivotally connected to the frame 14, as at 34, the rod end of units 32 being pivotally connected to a lever 36, the levers 36 each, in turn, being connected to the bucket 24 by means of a corresponding toggle link 37.

Rams 28 and piston and cylinder units 32 are each double acting and are suitably coupled with pump, conduit and value means (not shown) whereby rams 28 and piston and cylinder units 32 may be selectively operated by the operator of the front end loader 10 to swing the boom assembly 20 and, therefore bucket 24 from the lowered position, as shown in full lines in FIG. 1 to the raised position, as shown in dashed lines in FIG. 1 and to then return the bucket from the raised position to its lowered position, the piston and cylinder units 32 being utilized to control the attitude of the bucket 24 in the various positions of the boom assembly 20.

Normally, when the boom assembly 20 is in a lowered position, as illustrated in full lines in FIG. 1, the bucket 24 is disposed as shown in FIG. 1 whereby a cutting edge 38 provided along the normally forwardmost edge of bucket 24 is normally resting upon and parallel to the surface 40 upon which the loader 10 is working.

It should be noted that, when the bucket is in its lowered position the pivot pin 26 by which the boom arms 30 are connected to the bucket 24 is between the center of gravity of the bucket 24 and the front tires 16 and is also proximal to the surface 40 upon which the loader is working. Likewise, when the bucket is in its lowered position, the normally forwardmost cutting edge 38 is in a horizontal plane slightly below that of the pivotal mounting 26 of the bucket to the boom arms 30. It is also important that the minimal possible distance be achieved between the cutting edge 38 and the center line of the front axle 42 of the loader, this permitting the loader to develop greater bucket breakout force without raising the rear tires 18 off of the ground. The provision of the center of gravity of bucket 24 in close proximity to the front tires 16 provides for increased tip load rating of the loader 10 which correspondingly permits increasing the capacity rating of the bucket 24.

Power for the aforementioned pumps and hydraulic units is normally provided by the tractor, power unit 12. In the embodiment of the invention illustrated, the tractor 12 is coupled with the frame 14 through an articulated joint 43, although it will be appreciated that the tractor may be of any suitable construction; may be wheeled, as illustrated, or may be provided with tracks and also may be a rigid frame or articulated as illustrated.

A cab 44 is conventionally provided so that the operator of the loader 10 may view and control the operation thereof.

As disclosed in U.S. Pat. No. 3,363,792, there are provided a pair of balancing cylinders 46, these being in the form of energy storing means, such as piston and cylinder assemblies, and which are operable from a closed pressure system, the same being coupled to the boom so that energy is conserved by the system when the boom is lowered and this energy is utilized when the boom is raised to assist in balancing the boom, freeing other power sources to provide the primary lifting of the load.

The particular geometry of the loader, as hereinabove described, is especially intended for use with a bucket, such as 24, which bucket is provided with an ejector assembly as shown in more detail in FIGS. 2–6 of the drawings.

Referring to FIG. 6 for instance, it will be seen that there is provided, within the bucket 24, an ejector assembly broadly designated by the numeral 48, the ejector assembly being confined within the sidewalls 50 of the bucket 24.

Ejector assembly 48 includes, as its primary components, an upper panel 52; a lower panel 54, there being a hinge 56 interconnecting said panels as best illustrated in FIG. 3 of the drawing.

Protectived means 60 are provided for the hinge to prohibit the ingress of material from the bucket thereinto, the protective means 60 consisting of a half tube 62 which is secured to the innermost edge of lower panel 54 and moves with said panel when the ejector assembly 48 is activated, in the manner illustrated in FIG. 6 of the drawing, the ejector assembly 48 being shown in FIG. 6 in full lines in a rest position and in dashed lines in a fully operable position.

As shown in said figure, the ejector assembly 48, in its position of rest, has the upper panel 52 lying adjacent the rear wall of the bucket 24 and the lower panel 54 lying adjacent the lowermost or bottom wall of the bucket 24. Specifically, upper panel 52 is positioned in front of a stretch 64 of the bucket wall and lower panel 54 is positioned above and in front of a stretch 66 of the wall of bucket 24.

An opening is provided between stretches 64 and 66 to accommodate the hinge 56 and its associated operating mechanism when the ejector assembly is in a rest position, such being clearly shown in FIG. 6 of the drawing.

Likewise, an opening in the bucket wall is provided between stretch 64 and an uppermost stretch 68 of the bucket wall for receiving the operating mechanism for the ejector assembly 48.

Figure 2:
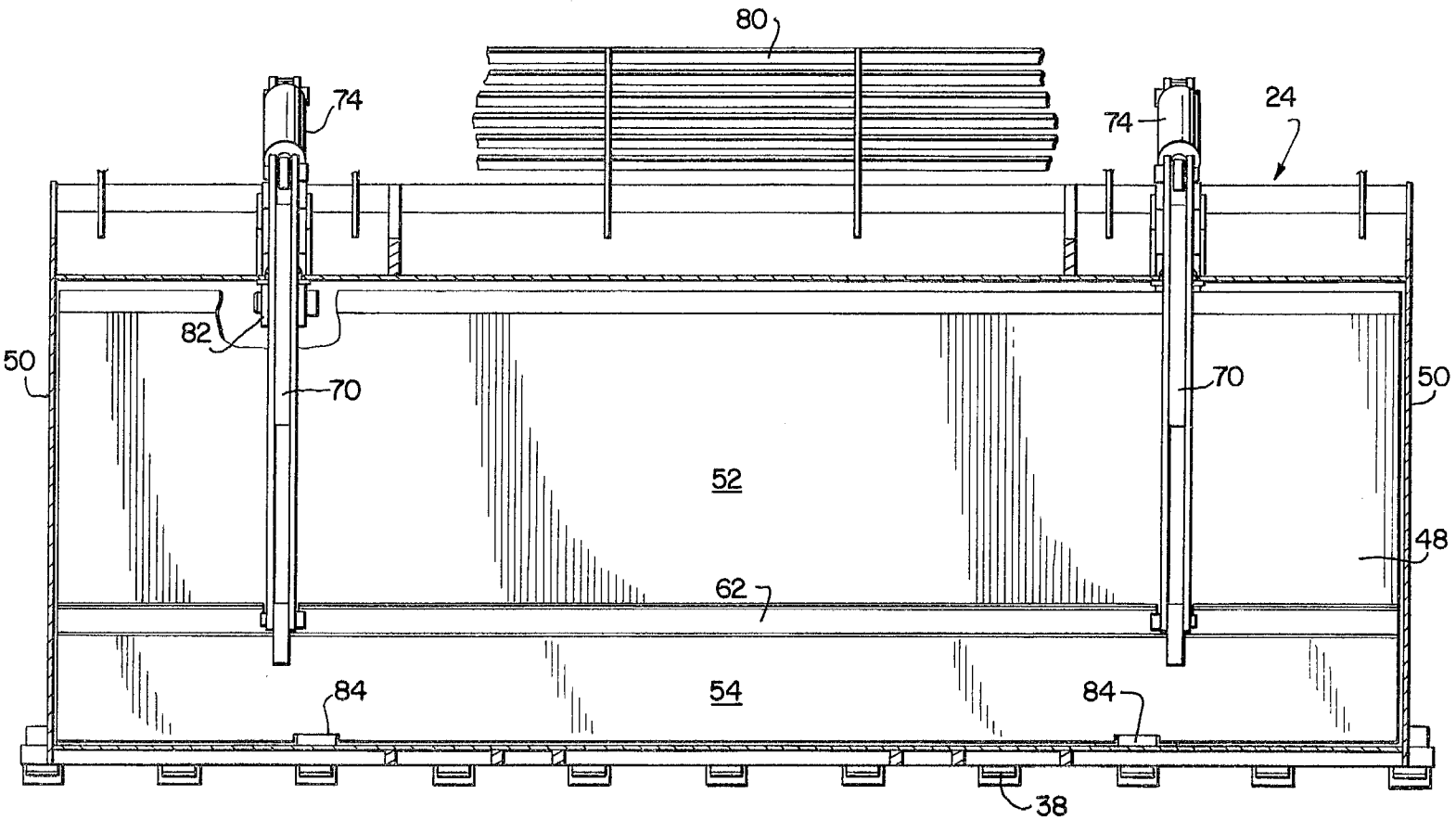
FIG. 2 is a front, partially fragmentary sectional view of the bucket taken generally along lines 2—2 of FIG. 6.

Such operating mechanism takes the form of a pair of arms 70 which extend through corresponding openings between stretches 64 and 68 and have the upper panel 52 mounted thereon. The free ends of arms 70 are coupled with a bell crank arrangement as at 72 which is in turn connected with an ejector cylinder unit 74. There is a cylinder 74 for each of the pair of arms 70 and it is important that the cylinders and arms be spaced apart, across the bucket, and as illustrated in FIG. 2. The cylinders 74 have their head end connected with a flange 76 at the upper edge of the bucket 24 and their piston end connected with bell crank 72 pivotally as shown at 78. The flange 76 is adjacent a spill guard 80 which is conventionally provided atop the bucket 24.

There is provided, within the bucket 24 and adjacent the opening between stretches 64 and 68, hinge means 82 for each of the arms 70, so that said arms may be swung about said hinge means 82, as illustrated, to move the panels 52 and 54 from their rest position to the operating position, in dashed lines, and whereby panels 52 and 54 essentially span the opening of the bucket 24.

It will be appreciated that, as the panels 52 and 54 are urged from the rest position to the operative position, all of the contents of bucket 24 will be readily rejected, even though the bucket itself remains in a horizontal position during the operation of the ejector assembly 48.

To aid in the operation of the ejector assembly and insure the cleaning of the bucket 24 during a dumping operation, a pair of rollers such as 84 are provided adjacent the normally forwardmost edge 86 of lower panel 54. The rollers are best shown in FIGS. 4 and 5 of the drawing and it will be seen that the same are mounted in suitable bearings, particularly selected to prevent the ingress of foreign materials and thus interfere with the operation of the rollers during the heavy and dirty operation normally experienced with loaders such as 10. A cover 88 is further provided to give the maximum protection to the rollers 84 and thus to further prevent the intrusion of dirt or other foreign material into the roller bearings, while at the same time, providing a compact design which may be readily disassembled in the field if necessary.

A shaft 90 extends through each of the rollers 84 and beyond each end thereof, the shaft 90 carrying, at each end thereof, a scraper arm 92 whereby to swingably mount a scraper 94 adjacent each of the rollers 84, the scraper extending the full width of the shaft 90. As illustrated in FIG. 6 for instance, the swingable mounting of the scraper 94 permits the same to readily follow the contour of the bottom wall of the bucket, as well as to ride over the forward cutting edge and teeth, as illustrated in the dashed lines in FIG. 6 of the drawing.

As is apparent from the foregoing description, the front end loader 10 as hereinabove described, may be readily used for moving bulk materials from the working surface such as 40, where such materials are normally piled or mined, into the raised dump body of a truck for transportation to another point. To accomplish this result, the bucket 24 is moved to its lowered position as shown in FIG. 1 in full lines and the loader is driven forward whereby a load of material may be picked up or forced into the interior of the bucket 24. The bucket is then rotated or tilted backward, about pin 26 by cylinders 32 through levers 36, to complete the digging or loading operation. During this operation, the ejector assembly 48 is in its position of rest and the hinge 56 is protected against ingress of the foreign material by virtue of the sealing means in the form of half tube 62, it being noted that tube 62 continually maintains a seal between plates 52 and 54 and over hinge 56 during all stages of operation of the ejector assembly 48.

Once the bucket has been loaded with material, the rams 28 are activated to raise the bucket, in its backwardly tilted condition, to full height, adjacent the open body of the truck into which the load is to be deposited. The bucket, in its backwardly tilted, fully raised position is shown in dot-dash lines in FIG. 1 of the drawing.

Once the full height position has been reached, the bucket is tilted forward to a horizontal position as shown in dashed lines in FIG. 1, and the contents thereof dumped from the bucket into the truck through the activation of ejector assembly 48, this being accomplished by simultaneously delivering fluid to cylinders 74 and thus swinging arms 70 to thereby move plates 52 and 54 to a position where they span the open mouth of the bucket 24 in an inclined position, as shown in FIG. 6, to thereby cause the material to slide from the bucket into the truck.

It will be further appreciated that, as the ejector assembly is moved from its position of rest to its fully operative position, the lower panel 54 will move along the bottom, inner face of the bucket 24 and remove any additional material or debris that would otherwise remain on the bottom of the bucket. Thus, the bucket is essentially fully cleaned during the dumping operation and furthermore foreign material is not allowed to enter the hinge 56 or the rollers 84, thereby providing a longer life for the ejector assembly 48.

Furthermore, and as hereinabove pointed out, the particular geometry of the boom assembly and bucket, with respect to the front axle and front tires permits several advantages, which result from the utilization of an ejector assembly as described.

Having thus described the invention, what is claimed as new and desired to be secured as Letters Patent is:

1. In a front end loader, a tractor having a pair of front tires and a pair of rear tires;

a boom assembly having one end thereof swingably connected to the tractor;

a bucket pivotally mounted on the other end of the boom assembly;

means for swinging said boom assembly and therefore said bucket, between a raised and a lowered position, the center of gravity of the bucket, when in a lowered position, being proximal to said front tires; and an ejector assembly for said bucket for ejecting the contents of the bucket when in a raised position, said ejector assembly including a pair of swingable panels within said bucket; a hinge joining said panels and means for sealing said hinge against the ingress of material within the bucket, said sealing means being in the form of a half tube on one of said panels and continuously overlying said hinge during operation of said ejector assembly.

2. A front end loader as set forth in claim 1, said panels including an upper panel and a lower panel, the half tube being secured to said lower panel adjacent the normally rearmost edge thereof.

3. A front end loader as set forth in claim 2, there being at least one roller carried at the normally forwardmost edge of said lower panel.

4. A front end loader as set forth in claim 3, there being a scraper swingably carried by said roller in front of the forwardmost edge of said lower panel.

5. A front end loader as set forth in claim 4, there being a pair of arms pivotally carried by said bucket and carrying said upper panel for swinging movement from a point adjacent the rear of the bucket to a point where said upper panel and said lower panel substantially span the bucket.

6. A front end loader as set forth in claim 5, there being a pair of spaced apart cylinders for driving said arms.

* * * * *